US005257504A

United States Patent [19]

Agrawal et al.

[11] Patent Number: 5,257,504

[45] Date of Patent: Nov. 2, 1993

[54] MULTIPLE REBOILER, DOUBLE COLUMN, ELEVATED PRESSURE AIR SEPARATION CYCLES AND THEIR INTEGRATION WITH GAS TURBINES

[75] Inventors: Rakesh Agrawal, Allentown; Jianguo Xu, Fogelsville, both of Pa.

[73] Assignee: Air Products and Chemicals, Inc., Allentown, Pa.

[21] Appl. No.: 837,786

[22] Filed: Feb. 18, 1992

[51] Int. Cl.[5] ..... F25J 3/02

[52] U.S. Cl. ..... 62/24; 62/37; 62/40

[58] Field of Search ..... 62/24, 37, 39

[56] References Cited

U.S. PATENT DOCUMENTS

| | | | |
|---|---|---|---|
| 3,210,951 | 10/1965 | Gaumer | 62/29 |
| 4,224,045 | 9/1980 | Olszewski | 62/30 |
| 4,702,757 | 10/1987 | Kleinberg | 62/24 |
| 4,732,595 | 3/1988 | Yoshino | 62/37 |
| 4,784,677 | 11/1988 | Al-Chalabi | 62/37 |
| 4,796,431 | 1/1989 | Erickson | 62/31 |
| 4,936,099 | 6/1990 | Woodward | 62/24 |
| 5,084,081 | 1/1992 | Rohde | 62/37 |
| 5,092,132 | 3/1992 | Marshall et al. | 62/38 |
| 5,098,456 | 3/1992 | Dray et al. | 62/38 |

FOREIGN PATENT DOCUMENTS 90402488.2 11/1990 European Pat. Off. .

*Primary Examiner*—Ronald C. Capossela

*Attorney, Agent, or Firm*—Willard Jones, II; William F. Marsh; James C. Simmons

[57] ABSTRACT

The present invention is a liquid nitrogen reflux means improvement capable of allowing the operation of conventional dual and triple reboiler air separation cycles at elevated pressures. The improvement comprises: (a) heat exchanging a portion of the liquid oxygen bottoms of the second column against a nitrogen vapor stream removed from the higher or lower pressure columns or derived from the gaseous nitrogen product, wherein prior to such heat exchange the pressure of the liquid oxygen bottoms portion or the nitrogen vapor stream or both the pressure of the liquid oxygen bottoms portion and the nitrogen vapor stream is adjusted by an effective amount so that an appropriate temperature difference exists between the liquid oxygen bottoms and the nitrogen vapor stream so that upon heat exchange the nitrogen vapor is totally condensed and the liquid oxygen bottoms portion is at least partially vaporized; (b) utilizing the condensed nitrogen as reflux in at least one of the two distillation columns; and (c) warming the vaporized oxygen to recover refrigeration.

26 Claims, 15 Drawing Sheets

AIR
GAN
GOX1
GOX2
100
102
104
106
108
110
112
114
116
118
120
122
124
126
128
130
132
134
136
138
140
142
144
146
148
150
152
160
162
164
166
168
170

AIR
100
102
HPGAN
242
GAN
152
GOX
226
126
128
130
132
104
106
108
112
244
234
134
114
136
116
118
110
138
140
122
120
142
150
160
124
240
144
262
238
236
264

CLEANUP
FUEL
100
102
104
106
108
110
112
114
116
118
120
122
124
126
128
130
132
134
136
138
140
142
144
150
152
160
234
236
238
262
264
266
500
502
504
506
508
510
512
514
518
520
522
524
526
528
552

GAN
152
952
954
100
AIR
266
GOX
HP
GAN
242
104
956
964
962
966
968
970
244
112
106
108
116
136
958
960
134
110
138
140
150
930
124
144
142
160
920
914
262
918
264

1172
1174
124
240
238
262
238
236
264
144
1140
160
1150
LIN
1142
1146
1144
150
1148
1170
116
136
140
138
122
120
118
110
142
114
234
134
132
128
130
244
1168
108
126
104
112
GOX1
1170
HPGAN
242
AIR
100
102
GOX2
266
106
GAN
152
WASTE
1176

MULTIPLE REBOILER, DOUBLE COLUMN, ELEVATED PRESSURE AIR SEPARATION CYCLES AND THEIR INTEGRATION WITH GAS TURBINES

TECHNICAL FIELD

The present invention is related to processes for the cryogenic distillation of air at elevated pressures having multiple reboiler/condensers in the lower pressure column and the integration of those processes with gas turbines.

BACKGROUND OF THE INVENTION

In certain circumstances, such as in oxygen-blown gasification-gas turbine power generation processes (e.g., coal plus oxygen derived fuel gas feeding the humidified air turbine cycle or the gas turbine-steam turbine combined cycle) or in processes for steel making by the direct reduction of iron ore (e.g., the CO-REX TM process) where the export gas is used for power generation, both oxygen and pressurized nitrogen products are required. This need for pressurized products makes it beneficial to run the air separation unit which produces the nitrogen and oxygen at an elevated pressure. At elevated operating pressures of the air separation unit, the sizes of heat exchangers, pipelines and the volumetric flows of the vapor fraction decrease, which together significantly reduces the capital cost of the air separation unit. This elevated operating pressure also reduces the power loss due to pressure drops in heat exchangers, pipelines and distillation columns, and brings the operating conditions inside the distillation column closer to equilibrium, so that the air separation unit is more power efficient. Since gasification-gas turbine and direct steel making processes are large oxygen consumers and large nitrogen consumers when the air separation unit is integrated into the base process, better process cycles suitable for elevated pressure operation are required. Numerous processes which are known in the art have been offered as a solution to this requirement, among these are the following.

U.S. Pat. No. 3,210,951 discloses a dual reboiler process cycle in which a fraction of the feed air is condensed to provide reboil for the low pressure column bottom. The condensed feed air is then used as impure reflux for the low pressure and/or high pressure column. The refrigeration for the top condenser of the high pressure column is provided by the vaporization of an intermediate liquid stream in the low pressure column.

U.S. Pat. No. 4,702,757 discloses a dual reboiler process in which a significant fraction of the feed air is partially condensed to provide reboil for the low pressure column bottom. The partially condensed air is then directly fed to the high pressure column. The refrigeration for the top condenser of the high pressure column is also provided by the vaporization of an intermediate liquid stream in the low pressure column.

U.S. Pat. No. 4,796,431 discloses a process with three reboilers located in the low pressure column. Also, U.S. Pat. No. 4,796,431 suggests that a fraction of the nitrogen removed from the top of the high pressure column is expanded to a medium pressure and then condensed against the vaporization of a fraction of the bottoms liquid from the lower column (crude liquid oxygen). This heat exchange will further reduce the irreversibilities in the upper column.

U.S. Pat. No. 4,936,099 also discloses a triple reboiler process. In this air separation process, the crude liquid oxygen bottoms from the bottom of the high pressure column is vaporized at a medium pressure against condensing nitrogen from the top of the high pressure column, and the resultant medium pressure oxygen-enrich air is then expanded through an expander into the low pressure column.

Unfortunately, the above cycles are only suitable for operation at low column operating pressures. As column pressure increases, the relative volatility between oxygen and nitrogen becomes smaller so more liquid nitrogen reflux is needed to achieve a reasonable recovery and substantial purity of the nitrogen product. The operating efficiency of the low pressure column of the above cycles starts to decline as the operating pressure increases beyond about 25 psia.

U.S. Pat. No. 4,224,045 discloses an integration of the conventional double column cycle air separation unit with a gas turbine. By simply taking a well known Linde double column system and increasing its pressure of operation, this patent is unable to fully exploit the opportunity presented by the product demand for both oxygen and nitrogen at high pressures.

Published European Patent Application No. 0,418,139 discloses the use of air as the heat transfer medium to avoid the direct heat link between the bottom end of the upper column and the top end of the lower column, which was claimed by U.S. Pat. No. 4,224,045 for its integration with a gas turbine. However, condensing and vaporizing the air not only increase the heat transfer area of the reboiler/condenser and the control cost, but also introduces extra inefficiencies due to the extra step of heat transfer, which makes its performance even worse than the Linde double column cycle.

U.S. Patent application Ser. No. 07/700,021, issued as U.S. Pat. No. 5,165,245 discloses how the pressure energy contained in the pressurized nitrogen (or waste) streams can be efficiently utilized to make liquid nitrogen and/or liquid oxygen.

SUMMARY OF THE INVENTION

The present invention is an improvement to a process for the cryogenic distillation of air to separate out and produce at least one of its constituent components. In the process, the cryogenic distillation is carried out in a distillation column system having at least two distillation columns operating at different pressures. A feed air stream is compressed to a pressure in the range between 70 and 300 psia (500 and 2,000 KPa) and essentially freed of impurities which freeze out at cryogenic temperatures. At least a portion of the compressed, essentially impurities-free feed air is cooled and fed to and rectified in the first of the two distillation columns thereby producing a higher pressure nitrogen overhead and a crude liquid oxygen bottoms. The crude liquid oxygen bottoms is reduced in pressure and fed to the second of the two distillation columns for distillation thereby producing a lower pressure nitrogen overhead and a liquid oxygen bottoms. A fraction of the cooled, compressed, essentially impurities-free feed air portion is at least partially condensed by heat exchange against the liquid oxygen bottoms in a first reboiler/condenser. The first reboiler/condenser can be located in the bottom of the second distillation column. The at least partially condensed fraction is fed to at least one of the two distillation columns as impure reflux. The cooled, compressed, essentially impurities-free feed air portion fed to the first of two distillation columns and the fraction of the cooled, compressed, essentially impurities-free feed air portion is at least partially condensed by heat exchange against the liquid oxygen bottoms in a first reboiler/condenser located in the bottom of the second distillation column are the same stream. At least a portion of the higher pressure nitrogen overhead is condensed by heat exchange against liquid descending the second distillation column in a second reboiler/condenser located in the low pressure column between the bottom of the second distillation column and the feed point of the crude liquid oxygen bottoms. The condensed higher pressure nitrogen is fed to at least one of the two distillation columns as reflux.

The improvement to the invention to allow effective operation of the process at elevated pressures comprises: (a) heat exchanging a portion of the liquid oxygen bottoms of the second column against a nitrogen vapor stream removed from the higher or lower pressure columns or derived from the gaseous nitrogen product, wherein prior to such heat exchange the pressure of the liquid oxygen bottoms portion or the nitrogen vapor stream or both the pressure of the liquid oxygen bottoms portion and the nitrogen vapor stream is adjusted by an effective amount so that an appropriate temperature difference exists between the liquid oxygen bottoms and the nitrogen vapor stream so that upon heat exchange the nitrogen vapor is totally condensed and the liquid oxygen bottoms portion is at least partially vaporized; (b) utilizing the condensed nitrogen as reflux in at least one of the two distillation columns; and (c) warming the vaporized oxygen to recover refrigeration. The improvement can further comprise work expanding the vaporized oxygen of step (c). Specific embodiments of step (a) would include: (i) only reducing the pressure of the liquid oxygen bottoms portion; (ii) only increasing the pressure of the nitrogen vapor stream; and (iii) increasing the pressure of the nitrogen vapor stream and the liquid oxygen bottoms portion.

The improvement is also applicable to the above process wherein another portion of the compressed, essentially impurities-free feed air is further compressed, cooled and work expanded to the operating pressure of the second distillation column and the expanded portion is fed to an intermediate location of the second distillation column. The work generated by work expanding the further compressed, cooled portion can be used to compress the other portion.

In the improvement, the nitrogen vapor condensed in step (b) can be a portion of the lower pressure nitrogen overhead with the condensed nitrogen of step (c) being utilized as reflux in the second distillation column or the nitrogen vapor can be a portion of the higher pressure nitrogen overhead.

The applicable process can further comprise recycling a fraction of a compressed nitrogen product to a reboiler/condenser located in the bottom of the second distillation column. Also, it can further comprise further compressing, cooling and work expanding a second fraction of the compressed nitrogen product; condensing the expanded second fraction by heat exchange against liquid descending the second column in a third reboiler/condenser located in the second distillation column between the feed point of the reduced pressure, crude liquid oxygen bottoms and the second reboiler/condenser; and using the condensed nitrogen as reflux for the second distillation column.

The process with its improvement is particularly applicable to integration with a gas turbine. When integrated, the compressed feed air to the cryogenic distillation process can be a portion of an air stream which is compressed in a compressor which is mechanically linked to a gas turbine. The integrated process can further comprise compressing at least a portion of a gaseous nitrogen product; feeding the compressed, gaseous nitrogen product, at least a portion of the compressed air stream which is not the feed air and a fuel in a combustor thereby producing a combustion gas; work expanding the combustion gas in the gas turbine; and using at least a portion of the work generated to drive the compressor mechanically linked to the gas turbine.

The improvement is also applicable to a process which further comprises work expanding a portion of the higher pressure nitrogen overhead; condensing the expanded nitrogen by heat exchange against liquid descending the second column in a third reboiler/condenser located in the second distillation column between the feed point of the reduced pressure, crude liquid oxygen bottoms and the second reboiler/condenser; and using the condensed nitrogen as reflux for the second distillation column, and still further comprises condensing the expanded portion in the third reboiler/condenser prior to introduction into the second distillation column.

Finally, the applicable process can further comprise condensing the expanded portion of nitrogen in a boiler/condenser against boiling crude liquid oxygen bottoms prior to introduction into the second distillation column.

DETAILED DESCRIPTION OF THE INVENTION

Multiple reboiler, multiple column cycles are typically more power efficient for low purity oxygen (80–99% purity) production. However, in order for the conventional, multi-column, dual and triple reboiler air separation process cycles to operate at elevated pressures yet have an adequate oxygen recovery and nitrogen product purity, a means of providing an effective quantity of liquid nitrogen reflux must be found. The present invention is the liquid nitrogen reflux means improvement capable of allowing the operation of conventional dual and triple reboiler air separation cycles at elevated pressures. The improvement comprises: (a) heat exchanging a portion of the liquid oxygen bottoms of the second column against a nitrogen vapor stream removed from the higher or lower pressure columns or derived from the gaseous nitrogen product, wherein prior to such heat exchange the pressure of the liquid oxygen bottoms portion or the nitrogen vapor stream or both the pressure of the liquid oxygen bottoms portion and the nitrogen vapor stream is adjusted by an effective amount so that an appropriate temperature difference exists between the liquid oxygen bottoms and the nitrogen vapor stream so that upon heat exchange the nitrogen vapor is totally condensed and the liquid oxygen bottoms portion is at least partially vaporized; (b) utilizing the condensed nitrogen as reflux in at least one of the two distillation columns; and (c) warming the vaporized oxygen to recover refrigeration.

The present invention is applicable to most conventional, multi-column, dual reboiler air separation process cycles. The present invention is particularly applicable to dual reboiler processes having at least two distillation columns which are in thermal communication with each other and operating at different pressures and having a reboiler/condenser located at the bottom of the lower pressure column, wherein at least a portion of the feed air is condensed in heat exchange against boiling liquid oxygen, and another reboiler/condenser located at an intermediate location of the lower pressure column between the bottom reboiler/condenser and the feed to the lower pressure column, wherein at least a portion of the nitrogen vapor from the higher pressure column is condensed in heat exchange against boiling liquid which is descending the lower pressure column.

Figure 11:
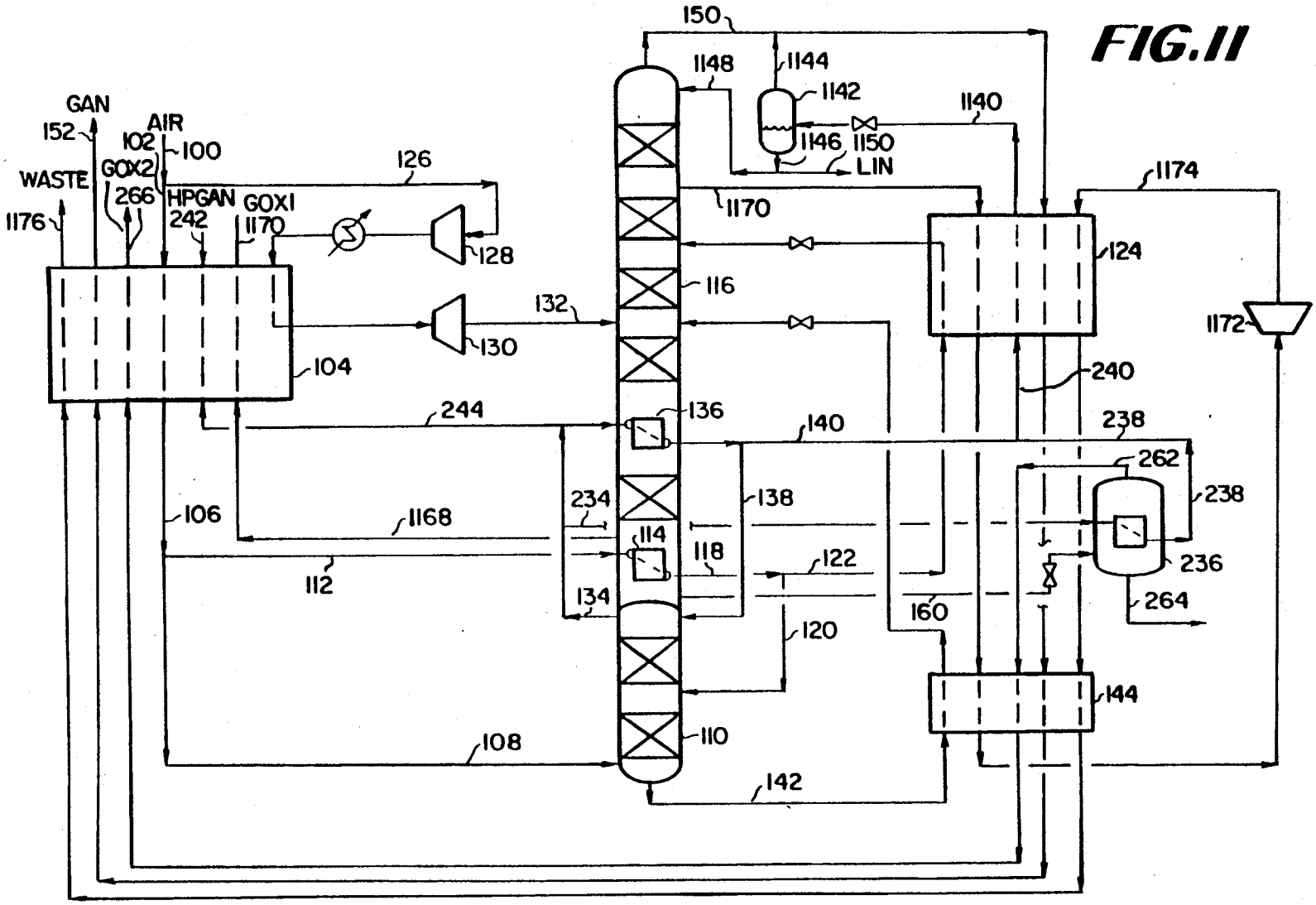
Figure 12:
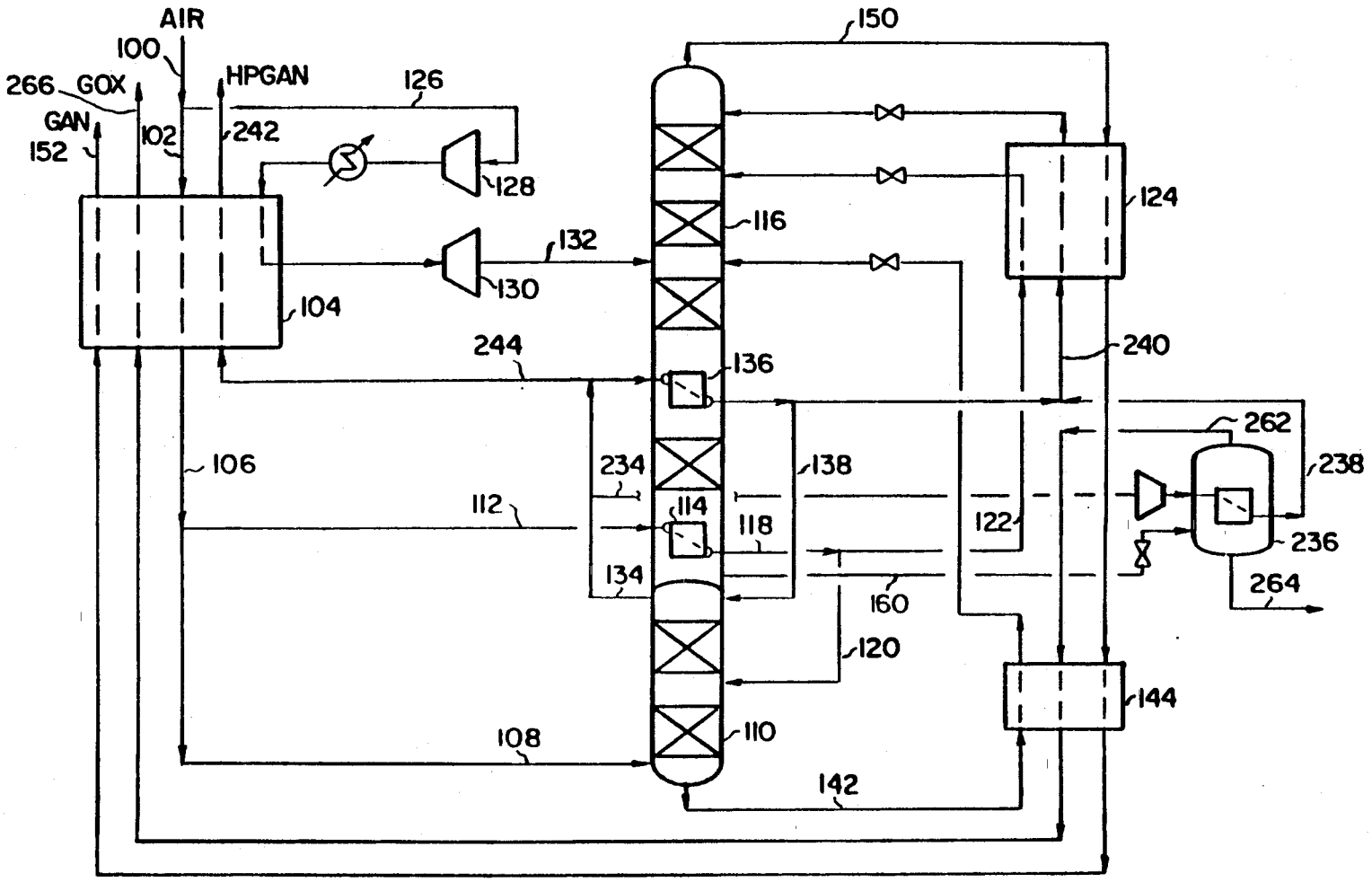
Figure 13:
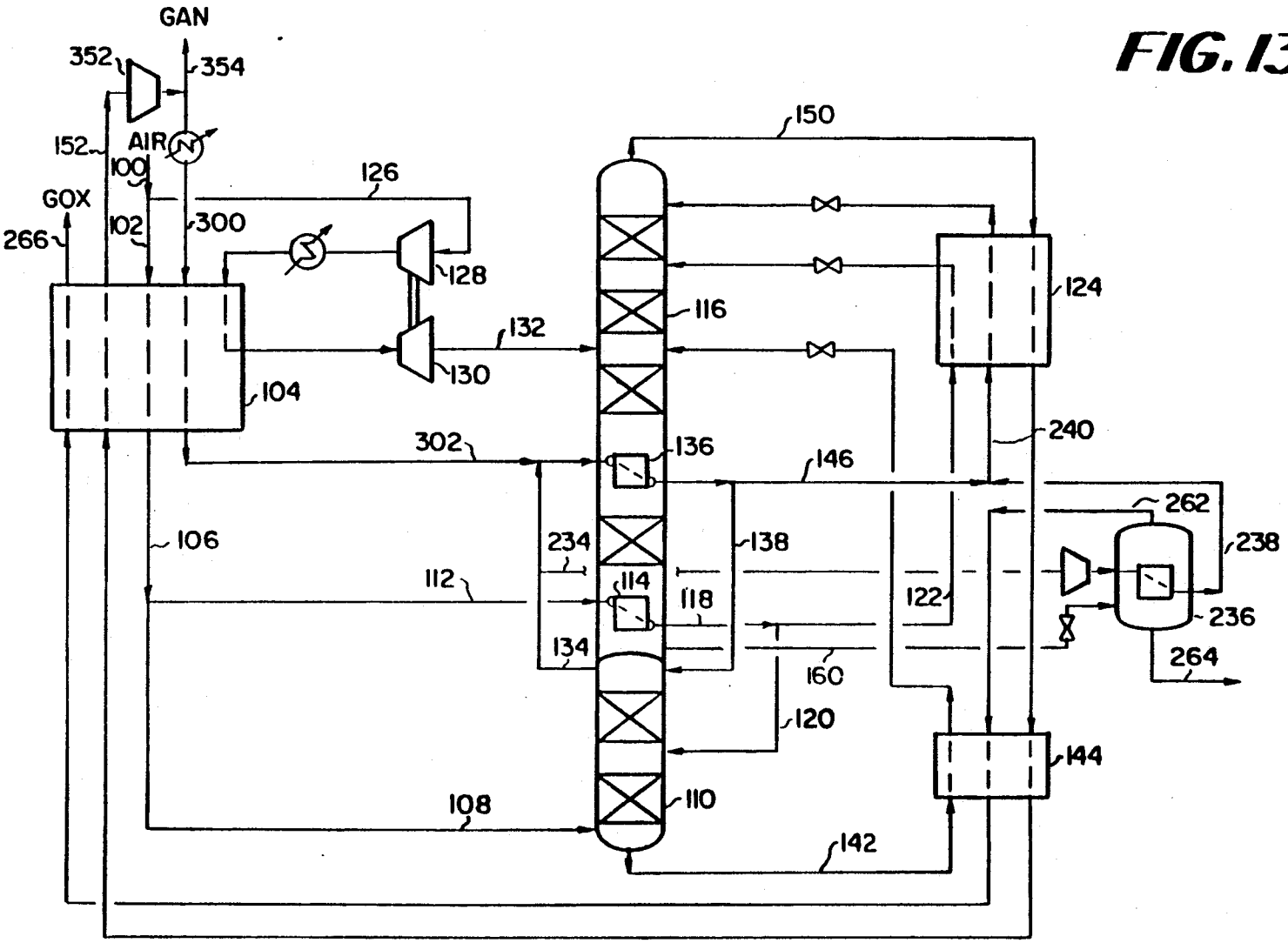
Figure 14:
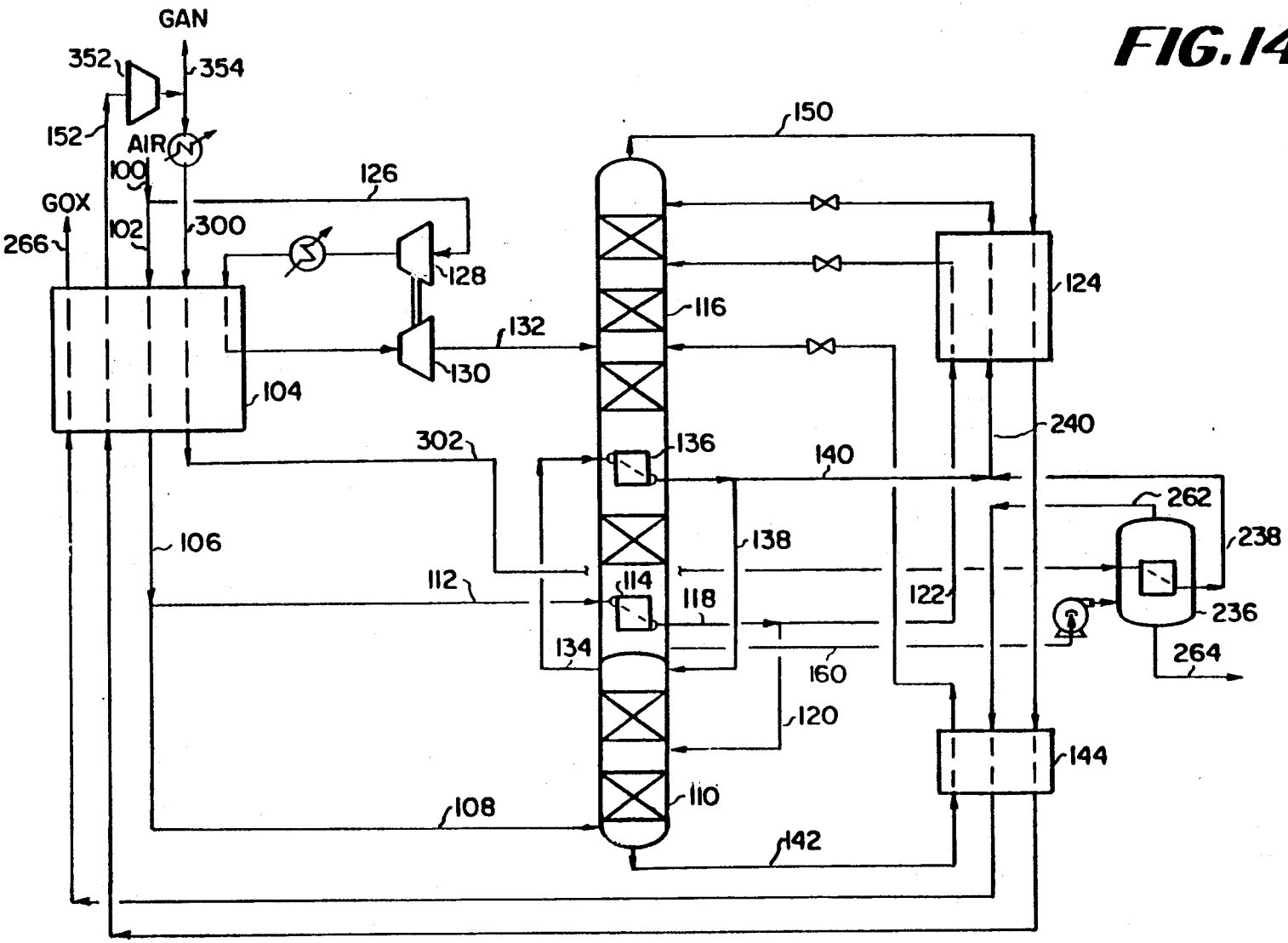

FIGS. 1 through 6 and 11 illustrate the applicability of the improvement to dual reboiler/condenser process embodiments, wherein in the improvement the nitrogen vapor is removed from either the higher or lower pressure column and the pressure of the liquid oxygen is reduced prior to heat exchange. FIGS. 12 and 13 illustrate the applicability of the improvement to dual reboiler/condenser process embodiments, wherein in the improvement the nitrogen vapor is removed from the higher pressure column and the pressure of the nitrogen vapor is increased prior to heat exchange. FIG. 14 illustrates the applicability of the improvement to dual reboiler/condenser embodiment, wherein in the improvement the nitrogen vapor is derived from a compressed, gaseous nitrogen product and the pressure of the liquid oxygen is increased prior to heat exchange.

The present invention is also applicable to most multi-column, triple reboiler process cycles. The present invention is particularly applicable to triple reboiler processes having at least two distillation columns which are in thermal communication with each other and operating at different pressures and having a reboiler/condenser located at the bottom of the lower pressure column, wherein at least a portion of the feed air is condensed in heat exchange against boiling liquid oxygen, and another reboiler/condenser located at an intermediate location of the lower pressure column between the bottom reboiler/condenser and the third reboiler/condenser, wherein at least a portion of the nitrogen vapor from the higher pressure column is condensed in heat exchange against boiling liquid which is descending the lower pressure column.

FIGS. 7 through 10 illustrate triple reboiler/condenser embodiments, wherein, in the improvement, the pressure of the liquid oxygen is reduced prior to heat exchange.

To better understand the present invention, the embodiments corresponding the above listed Figures will be described in detail.

Figure 1:
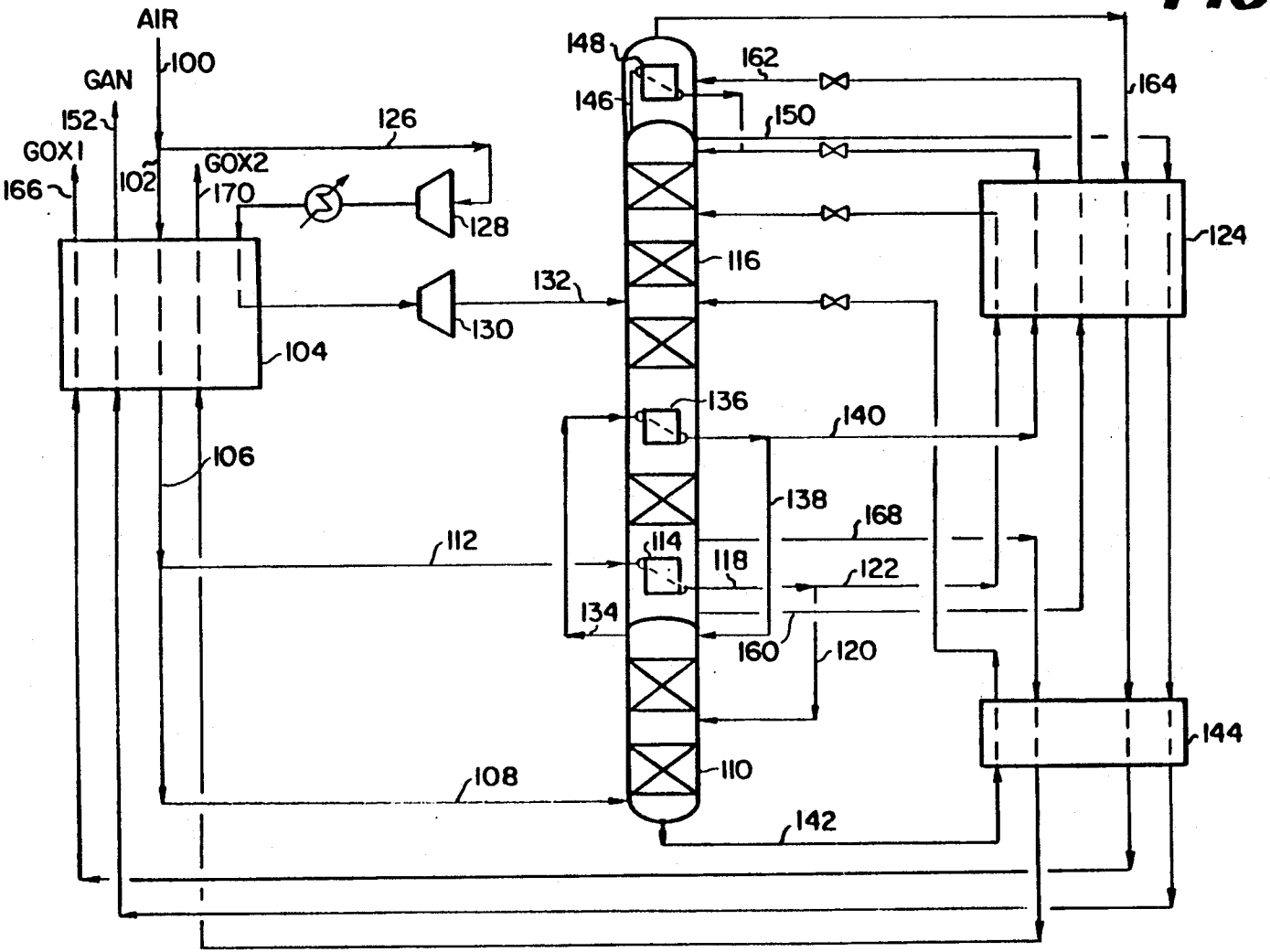
FIGS. 1–6 and 11–14 are flow diagrams of the process of the present invention having two reboiler/condensers in the lower pressure column.

With reference to FIG. 1, compressed, clean feed air is introduced to the process via line 100 and is split into two fractions, via lines 102 and 126, respectively.

The major fraction of feed air, in line 102, is cooled in main heat exchanger 104. This cooled air, now in line 106, is then further split into two portions, via lines 108 and 112, respectively. The first portion is fed via line 108 to the bottom of higher pressure column 110 for rectification. The second portion, in line 112, is condensed in reboiler/condenser 114 located in the bottom of lower pressure column 116. This condensed second portion, now in line 118, is split into two substreams via lines 120 and 122. The first substream, in line 120, is fed to an intermediate location of higher pressure column 110 as impure reflux. The second substream, in line 122, is subcooled in heat exchanger 124, reduced in pressure and fed to lower pressure column 116 at a location above the feed of the crude liquid oxygen from the bottom of higher pressure column 110 as impure reflux.

The minor fraction of the feed air, in line 126, is compressed in booster compressor 128, aftercooled, further cooled in main heat exchanger 104, work expanded in expander 130 and fed via line 132 to lower pressure column 116. As an option, all or part of the work produced by expander 130 can be used to drive booster compressor 128.

The feed air fed to higher pressure column 110 is rectified into a nitrogen overhead stream, in line 134, and a crude liquid oxygen bottoms, in line 142. The crude liquid oxygen bottoms, in line 142, is subcooled in heat exchanger 144, reduced in pressure and fed to an intermediate location of lower pressure column 116 for distillation. The nitrogen overhead, in line 134, is removed from higher pressure column 110 and condensed in reboiler/condenser 136 against vaporizing liquid descending lower pressure column 116. Reboiler/condenser 136 is located in lower pressure column 116 at a location between reboiler/condenser 114 and the feed of crude liquid oxygen from the bottom of higher pressure column 110, line 142. The condensed nitrogen from reboiler/condenser 136 is split into two substreams via line 138 and 140, respectively. The first substream, in line 138, is fed to the top of higher pressure column 110 as reflux. The second portion, in line 140, is subcooled in heat exchanger 124, reduced in pressure and fed to the top of lower pressure column 116 as reflux.

The crude liquid oxygen from the bottom of higher pressure column 110, in line 142, and the expanded second fraction of feed air, in line 132, which is introduced into lower pressure column 116 is distilled into a low pressure nitrogen overhead and a liquid oxygen bottoms. The low pressure nitrogen overhead is removed in two portions via lines 146 and 150. The first portion, in line 146, is condensed against vaporizing subcooled liquid oxygen, in boiler/condenser 148 and returned to the top of lower pressure column 116 as additional reflux. The second portion, in line 150, is warmed to recover refrigeration in heat exchangers 124, 144 and 104 and removed as a low pressure nitrogen product via line 152. A portion of the liquid oxygen bottoms is vaporized in reboiler/condenser 114 thus providing boil-up for lower pressure column 116. Another portion is removed from lower pressure column 116 via line 160 subcooled in heat exchanger 124, reduced in pressure and fed to the sump surrounding boiler/condenser 148 wherein it is vaporized. The vaporized oxygen is removed via line 164, warmed in heat exchangers 124, 144 and 104 to recover refrigeration and removed as a portion of the gaseous oxygen product via line 166. Finally, a portion of the oxygen boil-up in lower pressure column 116 is removed via line 168, warmed in heat exchangers 144 and 104 to recover refrigeration and recovered as a second portion of the gaseous oxygen product via line 170. The relative quantities of the two fractions of the gaseous oxygen product will depend on the operating pressure of lower pressure column 116. As the operating pressure of lower pressure column 116 is increased, the relative quantity of the second fraction of the gaseous oxygen product (in line 170) will decrease.

Figure 2:
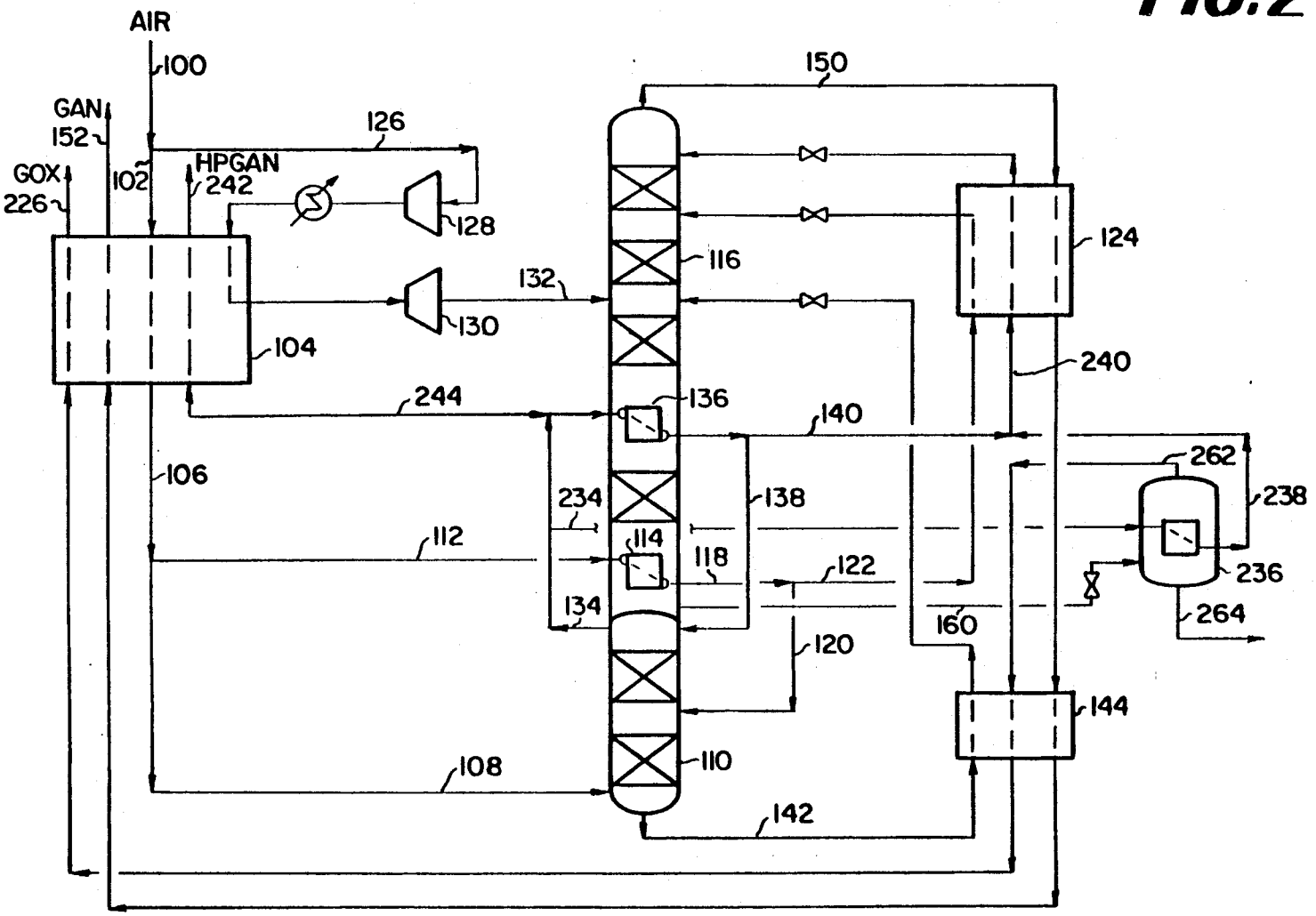

The process embodiment shown in FIG. 2 is similar to the process embodiment shown in FIG. 1. Throughout this disclosure, all functionally identical or equivalent equipment and streams are identified by the same number. The difference between FIG. 1 and 2 embodiments is that, in FIG. 2, the liquid oxygen bottoms portion from lower pressure column 116, in line 160, is reduced in pressure and vaporized in reboiler/condenser 236 against condensing nitrogen overhead, in line 234, from the top of higher pressure column 110. The condensed nitrogen, in line 238, is mixed with the condensed nitrogen, in line 140, to form low pressure reflux stream, in line 240. Alternatively, a portion of the condensed nitrogen in line 238 can be used to reflux higher pressure column 110. The low pressure reflux stream is subcooled in heat exchanger 124, reduced in pressure and introduced into the top of lower pressure column 116. Optionally, a portion of the nitrogen overhead is removed via line 244, warmed to recover refrigeration and recovered as a high pressure gaseous nitrogen product and a liquid oxygen product can be removed via line 264.

Figure 3:
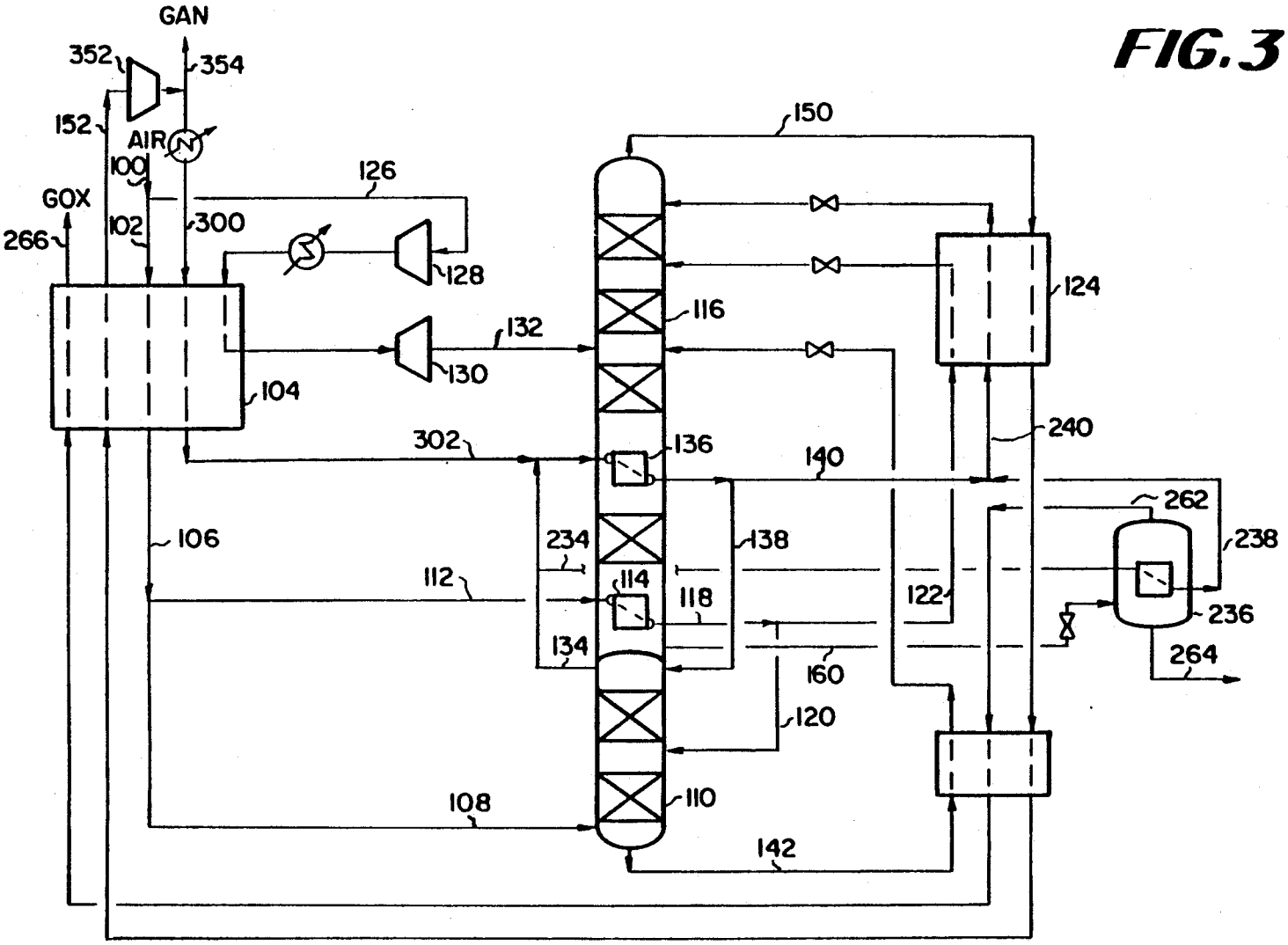

The process embodiment in FIG. 3 is based on the process embodiment of FIG. 2. The primary differences are that no high pressure nitrogen overhead is removed as product, all of the low pressure gaseous nitrogen product, in line 152, is boosted in pressure in compressor 352 and removed as a high pressure gaseous nitrogen product via line 354 and a portion of the boosted pressure nitrogen product is recycled via line 300 to the process. In particular, the recycle nitrogen, in line 300, is cooled in main heat exchanger 104 to a temperature near its dew point and mixed with the nitrogen overhead in line 134 to be fed to reboiler/condenser 136.

Figure 4:
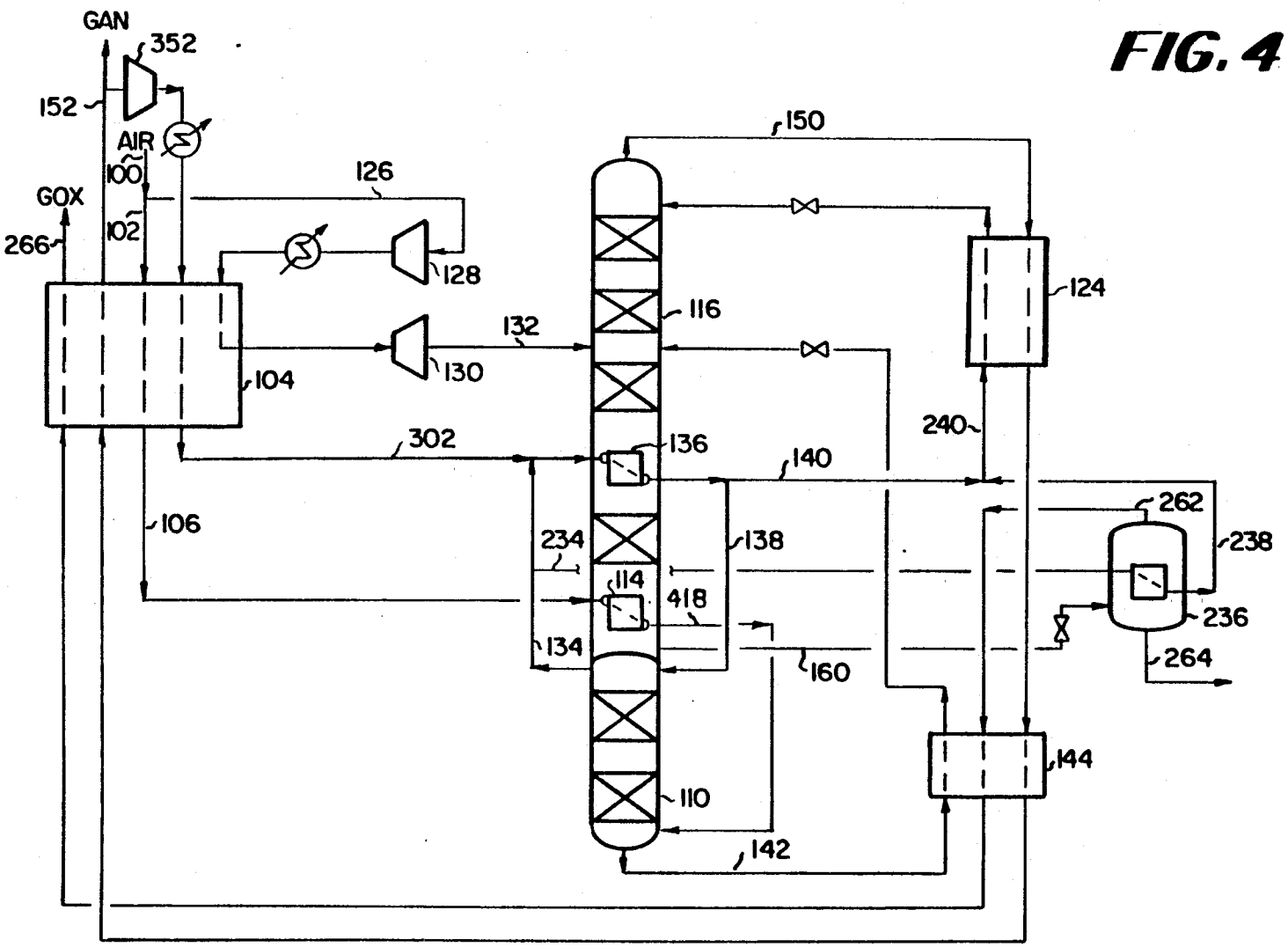

The process embodiment shown in FIG. 4 is essentially the same as process embodiment shown in FIG. 3, except no liquid air reflux is provided to either higher pressure column 110 or lower pressure column 116. In the FIG. 4 process embodiment, all of the cooled first fraction, in line 106, is fed to reboiler/condenser 114 wherein it is partially condensed. All of this partially condensed feed air fraction is then fed to the bottom of higher pressure column 110 via line 418.

Figure 5:
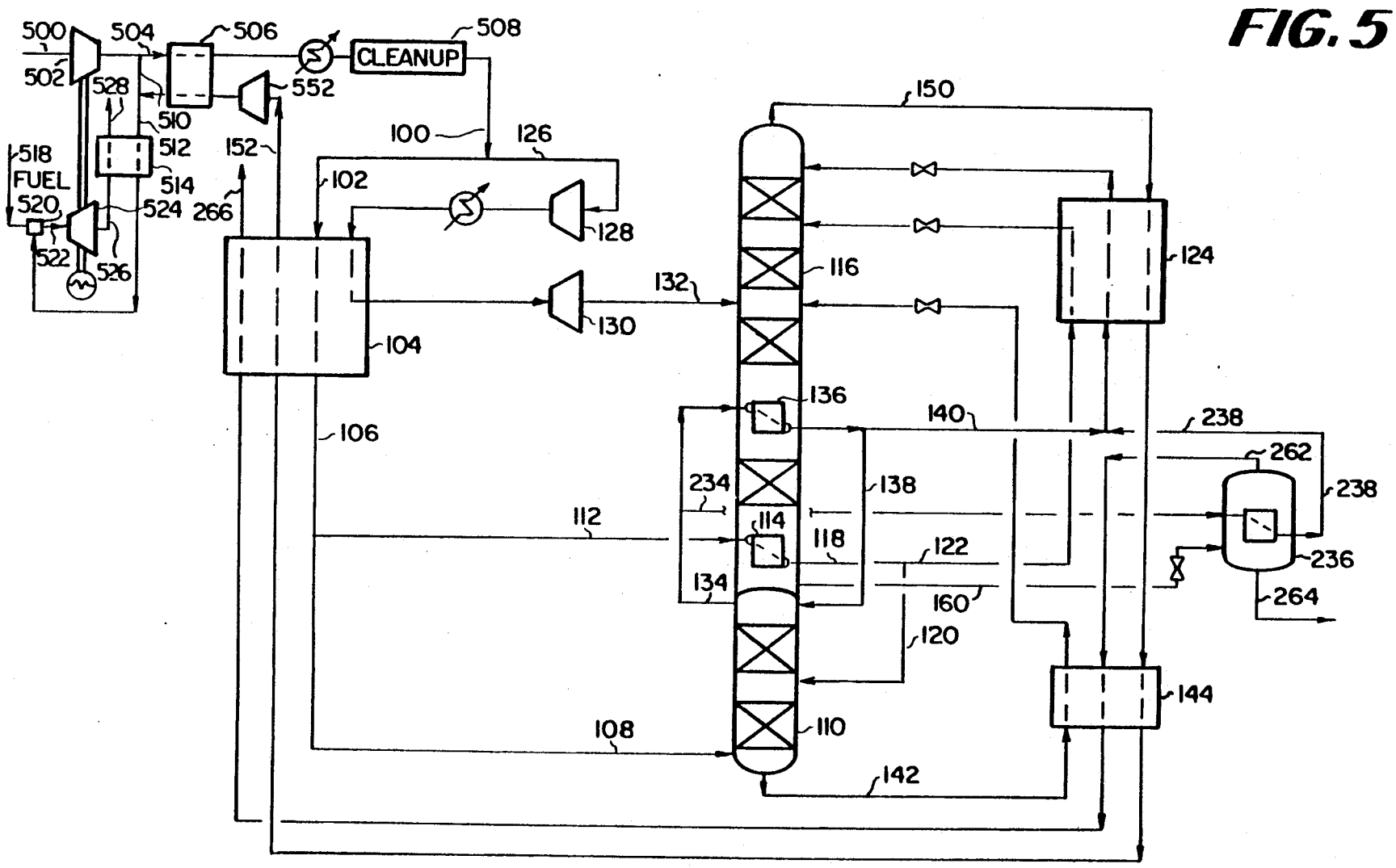

FIG. 5 depicts the process embodiment depicted in FIG. 2 integrated with a gas turbine. Since the air separation process embodiment for FIG. 2 has been described above, only the integration will be discussed here. FIG. 5 represents the socalled "fully integrated" option in which all of the feed air to the air separation process is supplied by the compressor mechanically linked to the gas turbine and all of the air separation process gaseous nitrogen product is fed to the gas turbine combustor. Alternatively, "partial integration" options could be used. In these "partial integration" options, part or none of the air separation feed air would come from the compressor mechanically linked to the gas turbine and part or none of the gaseous nitrogen product would be fed to the gas turbine combustor (i.e., where there is a superior alternative for the pressurized nitrogen product) The "fully integrated" embodiment depicted in FIG. 5 is only one example.

With reference to FIG. 5, feed air is fed to the process via line 500, compressed in compressor 502 and split into air separation unit and combustion air portions, in line 504 and 510, respectively. The air separation unit portion is cooled in heat exchanger 506, cleaned of impurities which would freeze out at cryogenic temperature in mole sieve unit 508 and fed to the air separation unit via line 100. The gaseous nitrogen product from the air separation unit, in line 152, is compressed in compressor 552, warmed in heat exchanger 506 and combined with the combustion air portion, in line 510. The combined combustion feed air stream, in line 512, is warmed in heat exchanger 514 and mixed with the fuel, in line 518. It should be noted that the nitrogen can be introduced at a number of alternative locations, for example mixed directly with the fuel gas or fed directly to the combustor. The fuel/combustion feed air stream is combusted in combustor 520 with the combustion gas product being fed to, via line 522, and work expanded in expander 524. FIG. 5 depicts a portion of the work produced in expander 524 as being used to compress the feed air in compressor 502. Nevertheless, all or the remaining work generated can be used for other purposes such as generating electricity. The expander exhaust gas, in line 526, is cooled in heat exchanger 514 and removed via line 528. The cooled, exhaust gas, in line 528, is then used for other purposes, such as generating steam in a combined cycle. It should be mentioned here that both nitrogen and air (as well as fuel gas) can be loaded with water to recover low level heat before being injected into the combustor. Such cycles will not be discussed in detail here.

Figure 6:
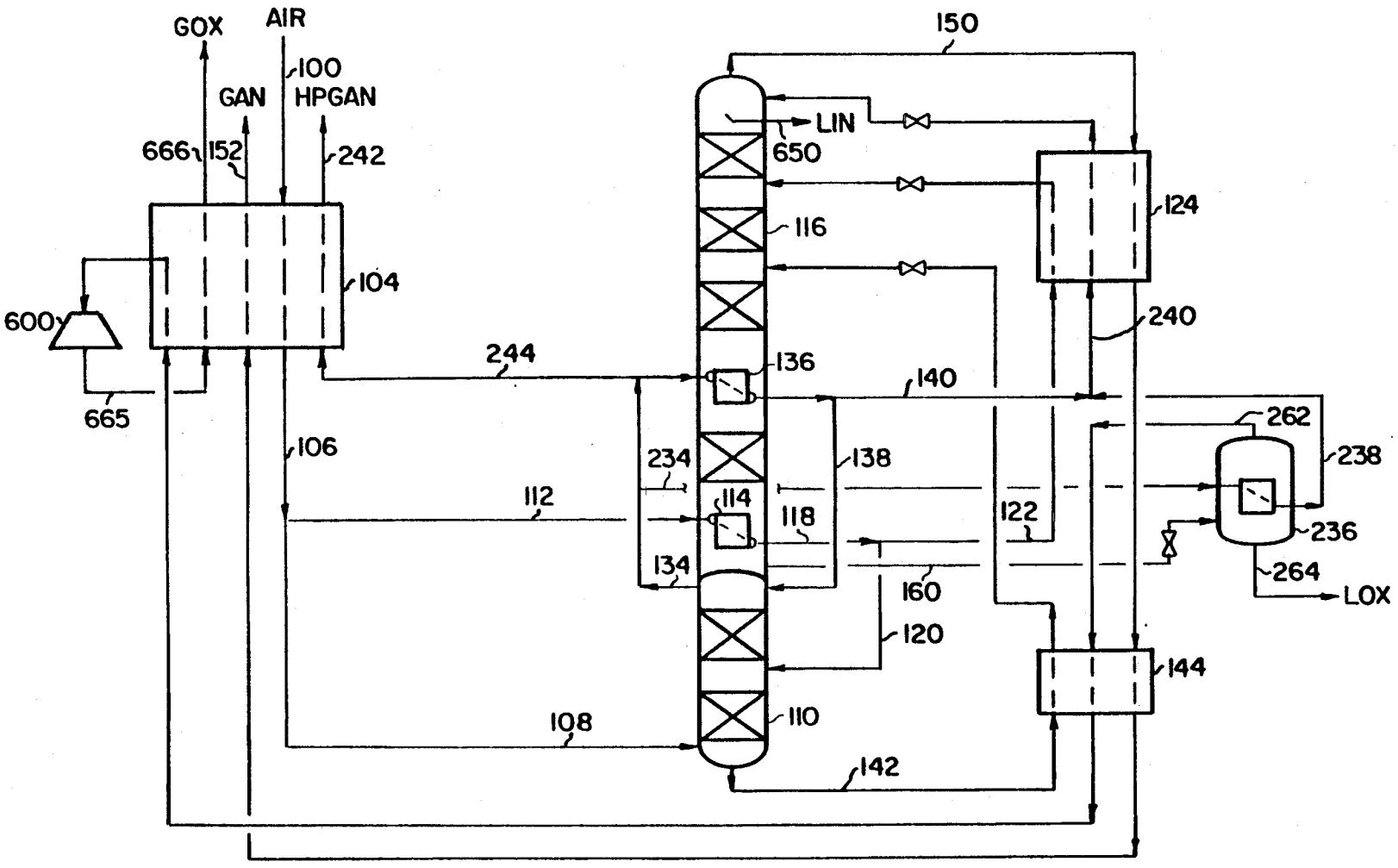

FIG. 6 depicts how a dual reboiler cycle shown in FIG. 2 can be used for situations for which only nitrogen is the desired product or for which both nitrogen and oxygen are needed, but the oxygen product does not have to be pressurized. The differences between this process embodiment and the one shown in FIG. 2 are as follow. First, the present embodiment does not employ the use of an air compander. Thus the entire feed air, in line 100, is cooled in 104. The cooled feed air, now in line 106, is then split into two portions as in FIG. 2. Second, the oxygen stream, in line 262, is warmed in heat exchanger 144 and partially in heat exchanger 104 is work expanded in expander 600. The resultant oxygen stream, in line 665, is warmed in heat exchanger 104 to recover refrigeration and either recovered or vented as a ambient pressure oxygen product. Finally, a small amount of liquid nitrogen can be removed from lower pressure column 116 via line 650.

Figure 7:
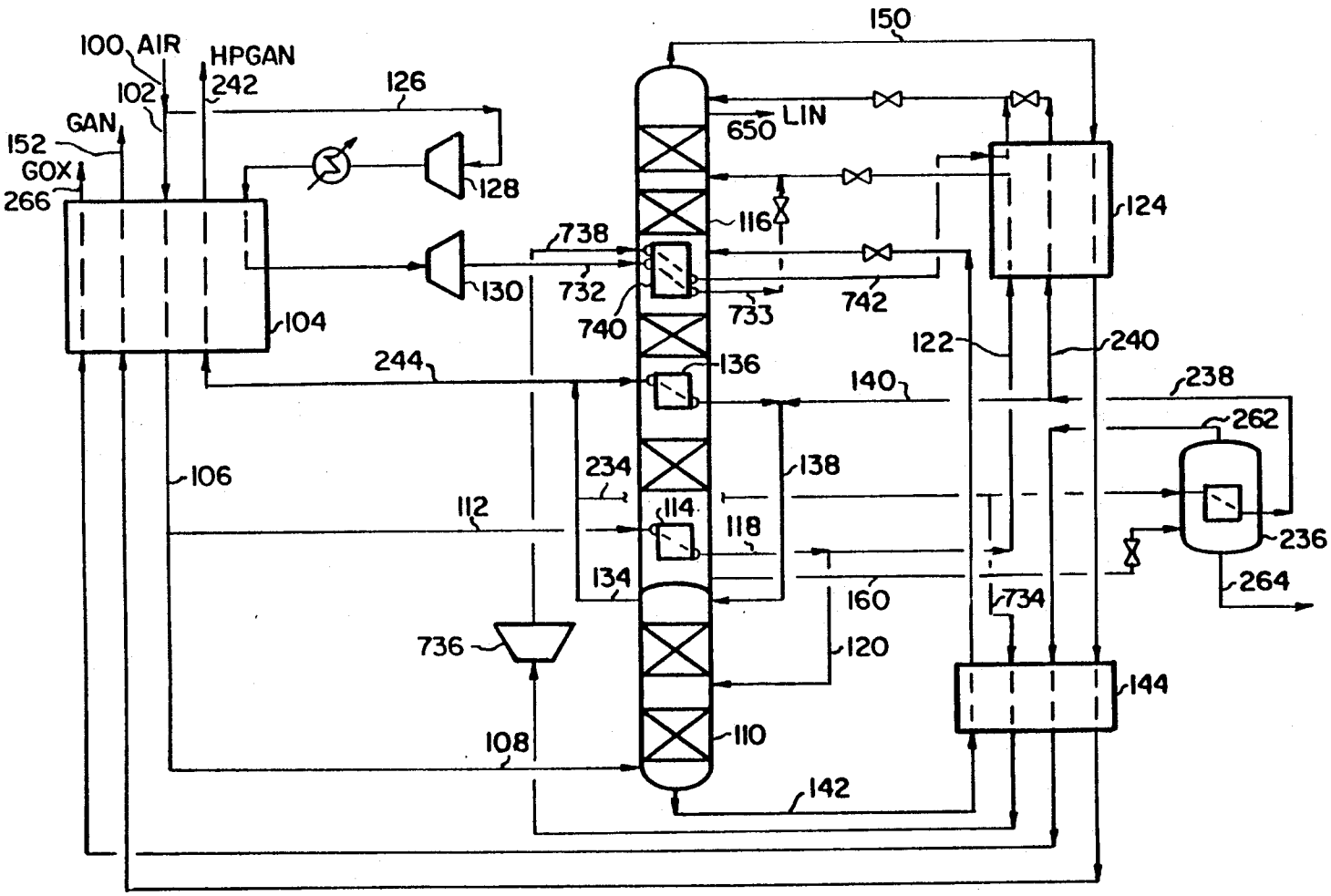
FIGS. 7–10 are flow diagrams of the process of the present invention having three reboiler/condensers in the lower pressure column.

The process embodiment in FIG. 7 is a scheme with triple reboiler with both medium pressure nitrogen and air condensation. By medium pressure it is meant that the pressure will be between the operating pressure of the high and lower pressure columns. The differences of this cycle from that of FIG. 2 are as follow. First, instead of expanding the further compressed second fraction in expander 130 to the pressure of lower pressure column 116 and feeding the expander air via line 132 to lower pressure column 116 directly, the further compressed second fraction is expanded to a medium pressure. This medium pressure stream, in line 732, is condensed in reboiler/condenser 740 located in lower pressure column 116 immediately below the feed position to lower pressure column 116. The condensed air is fed, via line 733, to lower pressure column 116 as impure reflux. Second, a fraction of the nitrogen gas, in line 234, is removed via line 734, warmed in heat exchanger 144, expanded to a medium pressure and fed via line 738 to reboiler/condenser 740. In reboiler/condenser 740, the expanded medium pressure nitrogen stream is condensed. The condensed nitrogen, in line 742, is subcooled in heat exchanger 124, reduced in pressure and fed to the top of lower pressure column 116 as additional reflux. Finally, since extra refrigeration is produced due to nitrogen expander 736, more liquid product can be produced from this embodiment.

Figure 8:
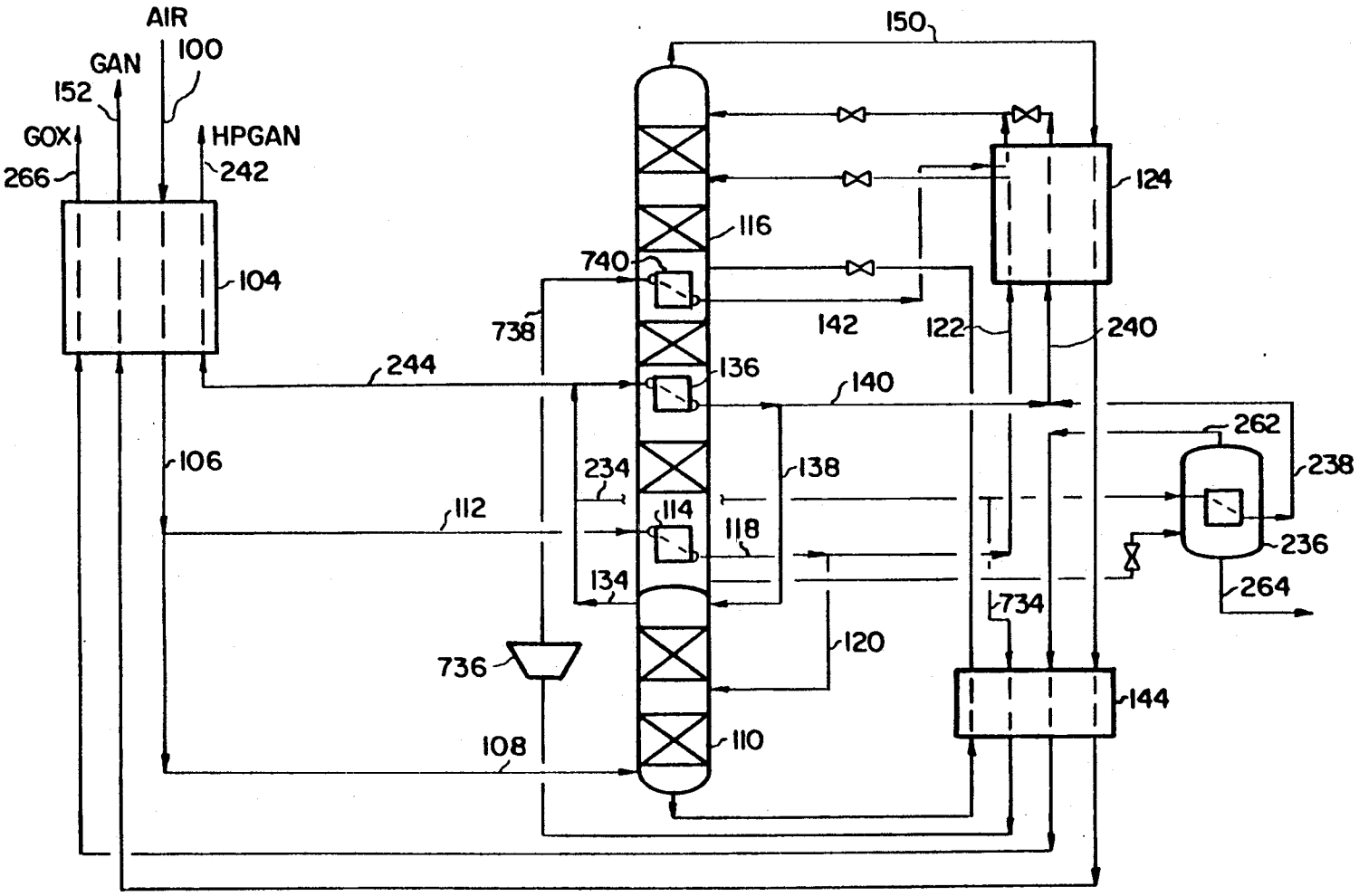

The embodiment shown in FIG. 8 is essentially a dual reboiler cycle and having medium pressure nitrogen condensation in the reboiler/condenser immediately below the feed position of the low pressure column only. This embodiment is an improvement to the process taught in U.S. Pat. No. 4,796,431. The only difference between the cycle of FIG. 8 and that of FIG. 7 is that in the process embodiment of FIG. 7 a portion of the feed air is companded (further compressed and expanded), then condensed in the same reboiler/condenser where the medium pressure nitrogen is condensed and subsequently fed to the lower pressure column; the process embodiment of FIG. 8 does not do such steps.

Alternatively, in the embodiments illustrated in FIGS. 7 and 8, the fraction of nitrogen gas in line 734 after being warmed in heat exchanger 144 can be further partially warmed in heat exchanger 104 and then work expanded in expander 736.

Figure 9:
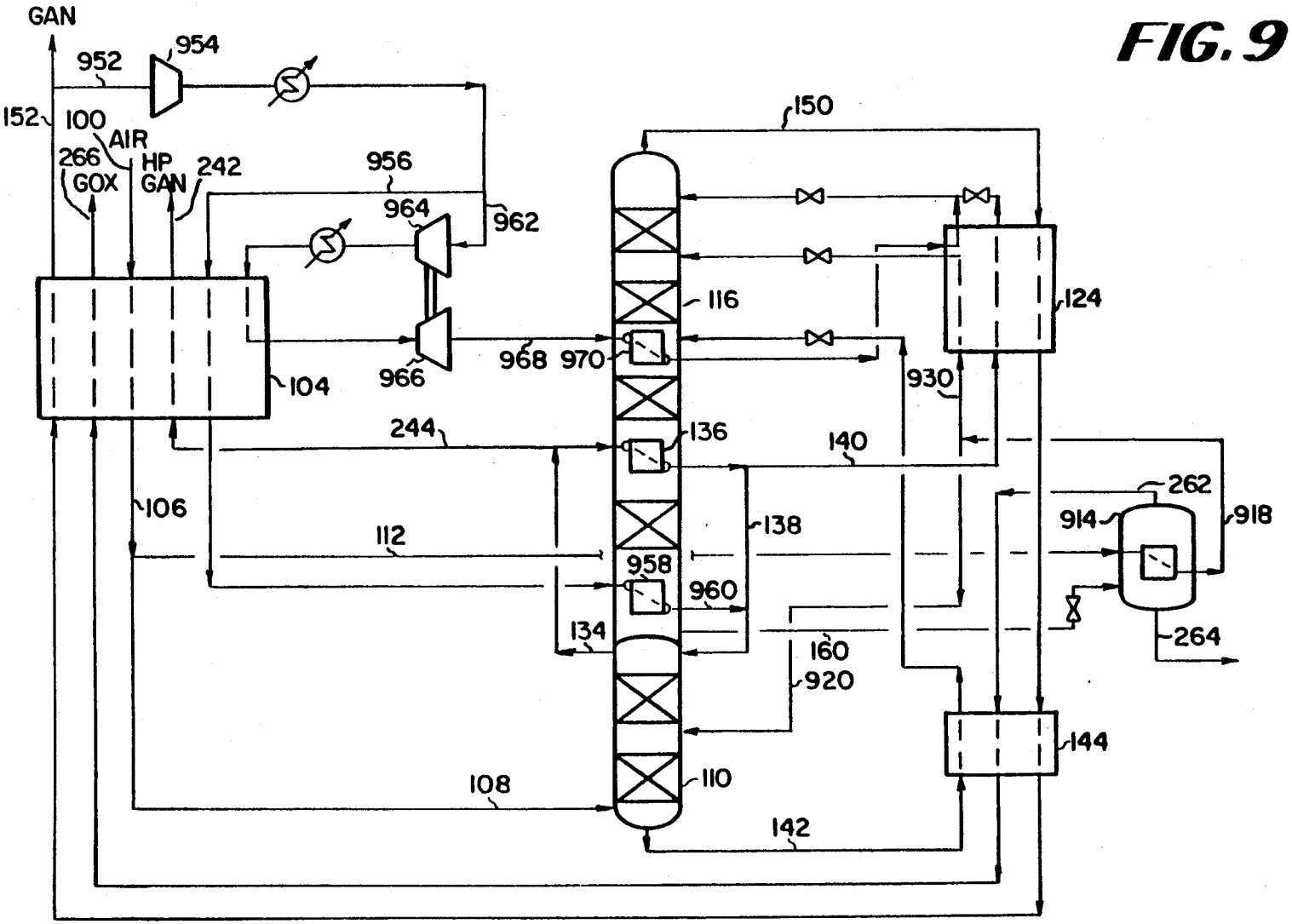

The embodiment shown in FIG. 9 is a triple reboiler scheme with recycle nitrogen stream. In the cycle, compressed, clean feed air is cooled in main heat exchanger 104 and split into two fractions, in lines 108 and 112, respectively. The first fraction, in line 108, is fed to the bottom of higher pressure column 110 for rectification into a nitrogen overhead, in line 134, and a crude liquid oxygen bottoms, in line 142. The second fraction, in line 112, is condensed in boiler/condenser 914 against boiling liquid oxygen, in line 160, and split into two portions, in lines 920 and 930, respectively. The first portion, in line 920, is fed as intermediate impure reflux to higher pressure column 110. The second portion, in line 930, is subcooled in heat exchanger 124, reduced in pressure and fed to an upper intermediate location of lower pressure column 116 as impure reflux.

A portion of the nitrogen product, in line 152, is removed via line 952, compressed in compressor 954, aftercooled, and split into two substreams, in lines 956 and 962, respectively. The first substream, in line 956, is cooled in main heat exchanger 104, condensed in reboiler/condenser 958 located in the bottom of lower pressure column 116 and fed to the top of higher pressure column 110 via line 960. The second substream, in line 962, is companded (compressed in compressor 964, cooled in main heat exchanger 104, and work expanded in expander 966). The companded second nitrogen substream is condensed in reboiler/condenser 970 located in an upper intermediate location of lower pressure column 116, subcooled, reduced in pressure and fed to the top of lower pressure column 116 as reflux.

The remainder of the process embodiment of FIG. 9 is the same as the process embodiment for FIG. 8.

Figure 10:
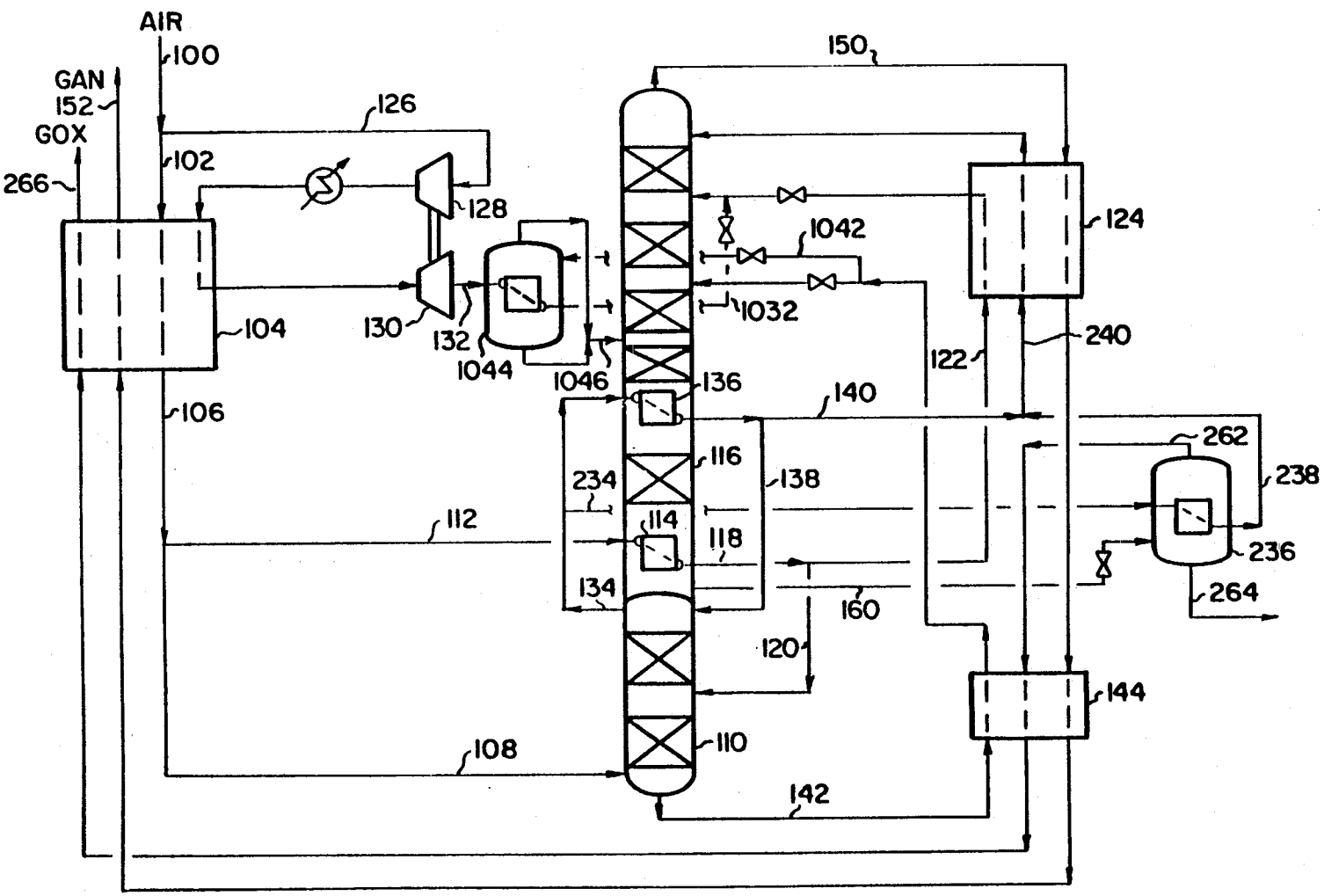

The process embodiment shown in FIG. 10 is another triple reboiler cycle. In this cycle, the expanded air, in stream 132, is fed to and condensed in boiler/condenser 1044 against boiling crude liquid oxygen, which is a portion of the crude liquid oxygen which is removed via line 1042, reduced in pressure and fed to the sump surrounding boiler/condenser 1044. The condensed air, in line 1032, is reduced in pressure and fed to lower pressure column 116 with stream 122. The partially vaporized crude oxygen is fed to the feed point of lower pressure column 116. The rest of the cycle is the same as that of FIG. 2.

Finally, it should be mentioned that such plants are not limited to gaseous oxygen and nitrogen production. The pressurized nitrogen (or waste) stream can be isentropically expanded to produce the refrigeration needed for liquid oxygen and/or nitrogen production. Besides, the oxygen can be taken out of the cold box at different pressures. Waste streams can also be taken out of the middle of the higher or lower pressure columns. FIG. 11 shows a dual reboiler/condenser cycle with such features. The embodiment of FIG. 11 is similar to that for FIG. 2; the differences are as follows. First, in the embodiment, a gaseous oxygen product is removed via line 1168 from the bottom of higher pressure column 116 above reboiler/condenser 114, warmed in heat exchanger 104 to recover refrigeration, and recovered as a secondary gaseous oxygen product via line 1170. Second, the condensed nitrogen, in line 240, is subcooled in heat exchanger 124, flashed and separated into a liquid phase and a gas phase in phase separator 1142. The gas phase is combined with the nitrogen product, in line 150, from lower pressure column 116. At least a portion of the liquid phase, in line 1146 is fed via line 1148 to lower pressure column 116 as reflux. The remainder of the liquid phase, in line 1146, is removed as liquid nitrogen product via line 1150. Finally, a waste stream is removed via line 1170 from lower pressure column 116, warmed in heat exchangers 124 and 144, work expanded in expander 1172, further warmed in heat exchangers 124, 144 and 104 to recover refrigeration and then vented via line 1176.

It should also be mentioned that if no nitrogen product is demanded under pressure, the nitrogen from the top of the low pressure column or nitrogen or waste stream from the higher pressure column can be expanded in a similar manner as the waste stream from the low pressure column, no matter whether a waste stream is taken out of the low pressure column. A combination of two expanders can be used to eliminate the air compander.

In all of the previously discussed embodiments the pressure of the liquid oxygen removed from the lower pressure column is reduced prior to heat exchange with the nitrogen vapor. As mentioned earlier, instead of reducing the pressure of the liquid oxygen bottoms portion, the pressure of the nitrogen vapor can be increased. FIGS. 12 and 13 illustrate the embodiments shown in FIGS. 2 and 3, respectively, except in FIGS. 12 and 13, the pressure of liquid oxygen stream 160 is not reduced in pressure prior to being fed to boiler/condenser 236 and the pressure of nitrogen vapor stream 234 is compressed prior to being fed to boiler/condenser 236. Compression of the nitrogen vapor can be done using cold or warm compression.

All of the previously discussed embodiments derive the nitrogen vapor for the improvement from either the higher or lower pressure columns. FIG. 14 illustrates an embodiment where the nitrogen vapor is derived from recycled, compressed nitrogen product. The embodiment of FIG. 14 is similar to the embodiment of FIG. 3. With reference to FIG. 14, the compressed nitrogen recycle in line 302 would be fed to heat exchanger 236 instead of the portion of the higher pressure nitrogen overhead in line 234. Furthermore, in FIG. 14, the pressure of the liquid oxygen boiling in boiler condenser 236 can be increased by pumping the liquid oxygen in line 160.

Figure 15:
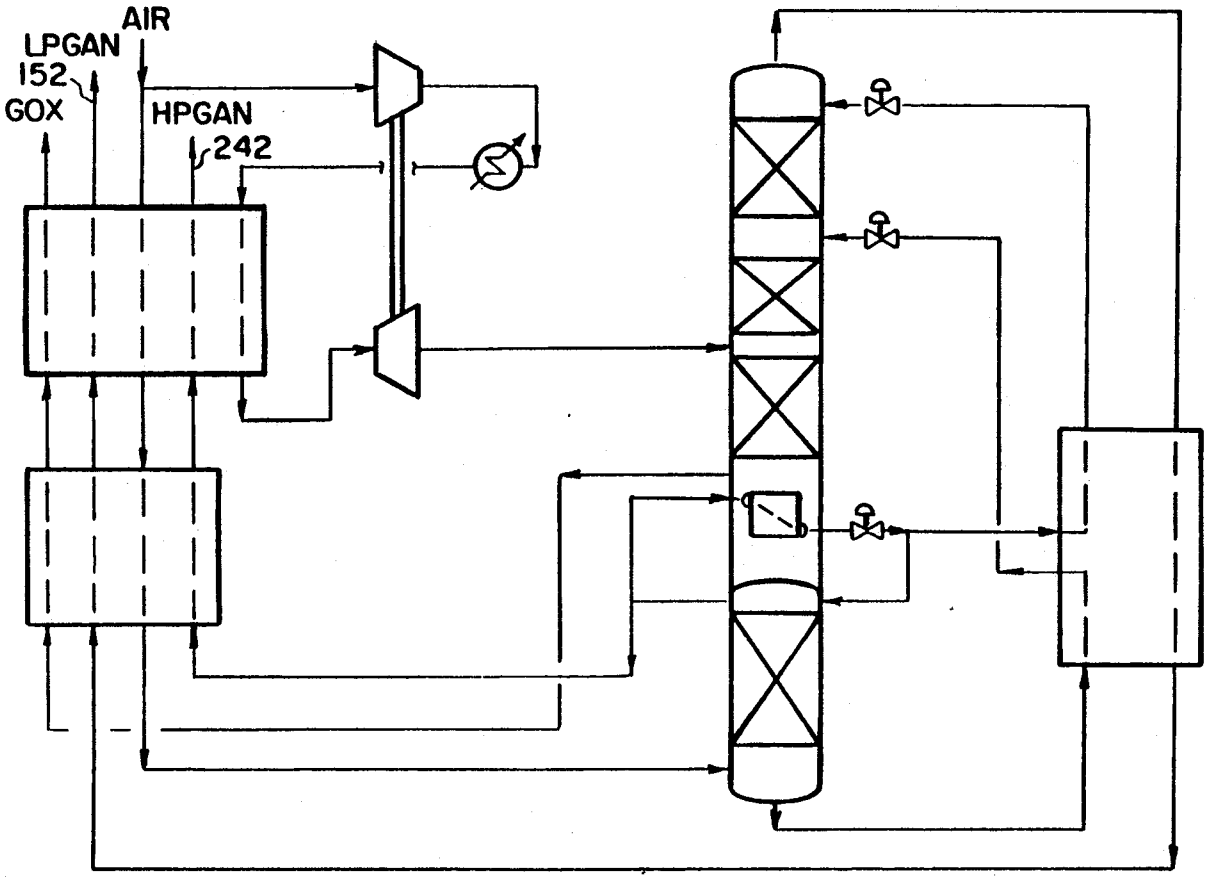
FIG. 15 PRIOR ART
FIG. 15 is a flow diagram of a conventional double (dual) column air separation cycle.

Finally, for purposes of comparison, a conventional double (dual) column cycle is shown in FIG. 15. The conventional double column cycle is well known in the art and therefore will be not explained in detail.

In order to demonstrate the efficacy of the present invention, several comparison examples were simulated. Since the conventional dual reboiler cycles do not provide the kind of oxygen recovery and nitrogen purity demanded, comparison between the cycles of invention and the conventional dual reboiler cycles is out of question. Therefore, comparison was made between the conventional double column cycle (FIG. 15) and the preferred embodiment shown in FIG. 2. The simulations were made at the following conditions: pressure of air to cold box=147 psia, $O_2$ purity=95%. The results of these simulations are shown in Table 1.

TABLE 1

| Cycle | No. of Theoretical Stages: Higher Pressure | No. of Theoretical Stages: Lower Pressure | Flow* Stream 242: mol/hr | Pressure Stream 152: psia | Oxygen Recovery*: mol | Power Ratio** |
|---|---|---|---|---|---|---|
| FIG. 15 | 45 | 35 | 9.5 | 43 | 20.42 | 1.0 |
| FIG. 2 | 45 | 60 | 6.0 | 53 | 20.63 | 0.96 |

*Basis: 100 mol/hr of Feed Air

**Comparison Basis:
Nitrogen Product Compressed to 139.5 psia
No Further Compression for Oxygen Product A comparison was also made between the conventional double (dual) column cycle shown in FIG. 15 and the preferred embodiment shown in FIG. 3. The simulations were made at the following conditions: pressure of air to cold box=207 psia, $O_2$ purity=90%. The results of these simulations are shown in Table 2.

TABLE 2

| Cycle | No. of Theoretical Stages: Higher Pressure | No. of Theoretical Stages: Lower Pressure | Flow* Stream 242: mol/hr | Flow* Stream 300: mol/hr | Oxygen Recovery*: mol | Power Ratio** |
|---|---|---|---|---|---|---|
| FIG. 15 | 50 | 40 | 3 | 0 | 20.31 | 1.0 |
| FIG. 3 | 50 | 65 | 0 | 6 | 20.45 | 0.96 |

*Basis: 100 mol/hr of Feed Air

**Comparison Basis:
Nitrogen Product Compressed to 139.5 psia
No Further Compression for Oxygen Product Notice that the power ratios are calculated based on the conventional double column cycle working under elevated pressures, and product nitrogen compressed to a pressure of 139.5 psia. If the power of the conventional low pressure cycle is used as the basis for comparison, the power savings in Table 1 is about 8%.

The advantage of using triple reboilers in the invention is shown by the comparison between the triple reboiler cycles shown in FIG. 7 and 8 with the dual reboiler cycle of the invention, that is, shown in FIG. 2. The conditions for simulation are as follows: pressure of air to cold box=147 psia, $O_2$ purity=95%. The results of the simulation are shown in Table 3.

TABLE 3

| Cycle | No. of Theoretical Stages: Lower Pressure | No. of Theoretical Stages: Higher Pressure | Oxygen Recovery: mol** | Liquid Oxygen Yield: mol** | Expander Power Credit+: KW | LOX Power Credit++: KW | Power Benefit: KW |
|---|---|---|---|---|---|---|---|
| FIG. 2 | 65 | 45 | 20.62 | 0.7 | — | Base | Base |
| FIG. 7 | 70 | 50 | 20.62 | 1.10 | 0.63 | 2.41 | 3.04 |
| FIG. 8 | 65 | 45 | 20.66 | 0.56 | 1.09 | −0.84 | 0.25 |

+Expander Power × 0.95 × 0.97
++Credit Calculation: LOX Yield × 390 KW/(T/hr)
**Basis: 100 mol/hr of Feed Air
Main Air Compressor Power: 93 KW It can be seen that while the power efficiency of the triple reboiler cycle with medium nitrogen condensation only in the reboiler/condenser immediately below the feed position of the low pressure column (FIG. 8) is only marginally better than the dual reboiler cycle of the invention, that with both medium pressure air and nitrogen condensation (FIG. 7) is significantly better.

Finally, the parameters of the important streams from the simulation of cycle FIG. 2 (with and without LOX) and FIG. 7 are listed in Tables 4 through 6, respectively.

TABLE 4

Selected Stream Parameters for the FIG. 2 Process Embodiment Without LOX Production

| | Stream Number 100 | 106 | 108 | 112 | 118 | 120 | 132 | 142 | 240 | 262 | 150 | 240 |
|---|---|---|---|---|---|---|---|---|---|---|---|---|
| Pressure: psia | 147.0 | 145.5 | 145.5 | 145.5 | 145.2 | 145.2 | 58.6 | 145.4 | 142.5 | 48.9 | 55.0 | 142.0 |
| Temperature: °F. | 55.0 | −253.6 | −253.0 | −253.0 | −268.4 | −268.4 | −250.5 | −264.6 | −273.3 | −274.7 | −296.2 | −273.3 |
| Flow: mol/hr | 100.0 | 87.5 | 79.0 | 18.5 | 18.5 | 7.4 | 2.5 | 48.6 | 6.0 | 21.7 | 72.3 | 31.8 |

TABLE 5

Selected Stream Parameters for the FIG. 2 Process Embodiment With LOX Production

| | Stream Number 100 | 106 | 108 | 112 | 118 | 120 | 132 | 142 | 264 | 262 | 150 | 240 |
|---|---|---|---|---|---|---|---|---|---|---|---|---|
| Pressure: psia | 147.0 | 145.5 | 145.5 | 145.5 | 145.2 | 145.2 | 58.5 | 145.4 | 50.0 | 48.9 | 55.0 | 132.0 |
| Temperature: °F. | 55.0 | −256.0 | −255.3 | −255.3 | −268.4 | −268.4 | −250.6 | −264.7 | −276.0 | −274.7 | −296.2 | −273.3 |
| Flow: mol/hr | 100.0 | 90.8 | 73.5 | 17.2 | 17.2 | 6.9 | 9.2 | 45.5 | 0.7 | 21.0 | 78.3 | 34.9 |

TABLE 6

Selected Stream Parameters for the FIG. 7 Process Embodiment

| | Stream Number | | | | | | | | | | | |
|---|---|---|---|---|---|---|---|---|---|---|---|---|
| | 100 | 106 | 732 | 733 | 108 | 112 | 120 | 142 | 264 | 150 | 738 | 240 |
| Pressure: psia | 147.0 | 145.5 | 83.5 | 83.2 | 145.5 | 145.5 | 145.2 | 145.4 | 47.0 | 55.0 | 94.0 | 142.2 |
| Temperature: °F. | 55.0 | −259.4 | −209.4 | −283.3 | −258.8 | −258.8 | −264.8 | −264.8 | −276.0 | −296.2 | −284.1 | −273.3 |
| Flow: mol/hr | 100.0 | 88.8 | 11.2 | 11.2 | 70.1 | 18.6 | 8.4 | 44.8 | 1.1 | 78.3 | 22.0 | 11.8 |

The present invention has been described with reference to several specific embodiments thereof. These embodiments should not be viewed as a limitation of the present invention. The scope of the present invention should be ascertained from the following claims.

We claim:

1. In a process for the cryogenic distillation of air to separate out and produce at least one of its constituent components, wherein the cryogenic distillation is carried out in a distillation column system having at least two distillation columns operating at different pressures; a feed air stream is compressed to a pressure in the range between 70 and 300 psia (500 and 2,000 kPa) and essentially freed of impurities which freeze out at cryogenic temperatures; at least a portion of the compressed, essentially impurities-free feed air is cooled and fed to and rectified in the first of the two distillation columns thereby producing a higher pressure nitrogen overhead and a crude liquid oxygen bottoms; the crude oxygen bottoms is reduced in pressure and fed to the second of the two distillation columns for distillation thereby producing a lower pressure nitrogen overhead and a liquid oxygen bottoms; a fraction of the cooled, compressed, essentially impurities-free feed air portion is at least partially condensed by heat exchange against the liquid oxygen bottoms in a first reboiler/condenser and fed to at least one of the two distillation columns; at least a portion of the higher pressure nitrogen overhead is condensed by heat exchange against liquid descending the second distillation column in a second reboiler/condenser located in the low pressure column between the bottom of the second distillation column and the feed point of the crude liquid oxygen bottoms; the condensed higher pressure nitrogen is fed to at least one of the two distillation columns as reflux; and a gaseous nitrogen product is produced; the improvement to allow effective operation of the process at elevated pressures comprises:

(a) heat exchanging a portion of the liquid oxygen bottoms of the second column against a nitrogen vapor stream, wherein prior to such heat exchange the pressure of at least one of the two streams being heat exchanged against each other undergoes a change in an operation that achieves a temperature difference between the liquid oxygen bottoms and the nitrogen vapor stream so that upon heat exchange the nitrogen vapor is totally condensed and the liquid oxygen bottoms portion is at least partially vaporized;

(b) utilizing the condensed nitrogen as reflux in at least one of the two distillation columns; and (c) warming the vaporized oxygen to recover refrigeration.

2. The process of claim 1 wherein another portion of the compressed, essentially impurities-free feed air is further compressed, cooled and work expanded to the operating pressure of the second distillation column and the expanded portion is fed to an intermediate location of the second distillation column.

3. The process of claim 2 wherein the nitrogen vapor condensed in step (a) is a portion of the lower pressure nitrogen overhead and the condensed nitrogen is utilized as reflux in the second distillation column.

4. The process of claim 2 wherein the nitrogen vapor condensed in step (a) is a portion of the higher pressure nitrogen overhead and the condensed nitrogen is utilized as reflux in the second distillation column.

5. The process of claim 4 which further comprises further compressing, cooling and work expanding a second fraction of the compressed nitrogen product; condensing the expanded second fraction by heat exchange against liquid descending the second column in a third reboiler/condenser located in the second distillation column between the feed point of the reduced pressure, crude liquid oxygen bottoms and the second reboiler/condenser; and using the condensed nitrogen as reflux for the second distillation column.

6. The process of claim 2 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically lined to the gas turbine.

7. The process of claim 6 wherein at least a portion of the compressed feed air is derived from the air stream which has been compressed in the compressor which is mechanically linked to the gas turbine.

8. The process of claim 2 which further comprised work expanding the vaporized oxygen of step (c).

9. The process of claim 2 which further comprises work expanding a portion of the higher pressure nitrogen overhead; condensing the expanded nitrogen by heat exchange against liquid descending the second column in a third reboiler/condenser located in the second distillation column between the feed point of the reduced pressure, crude liquid oxygen bottoms and the second reboiler/condenser; and using the condensed nitrogen as reflux for the second distillation column.

10. The process of claim 2 which further comprises condensing the expanded portion in a boiler/condenser against boiling crude liquid oxygen bottoms prior to introduction into the second distillation column.

11. The process of claim 2 wherein the work generated by work expanding the further compressed, cooled portion is used to compress the other portion.

12. The process of claim 1 wherein the nitrogen vapor condensed in step (a) is a portion of the higher pressure nitrogen overhead and the condensed nitrogen is utilized as reflux in the second distillation column.

13. The process of claim 12 which further comprises compressing at least a fraction of the nitrogen product and recycling at least a portion thereof to the second reboiler/condenser.

14. The process of claim 1 wherein the nitrogen vapor condensed in step (a) is a portion of the lower pressure nitrogen overhead and the condensed nitrogen is utilized as reflux in the second distillation column.

15. The process of claim 1 wherein an air stream is compressed in a compressor which is mechanically linked to a gas turbine and which further comprises compressing at least a portion of the gaseous nitrogen produced from the process for the cryogenic distillation of air; combusting the compressed, gaseous nitrogen, at least a portion of the compressed air stream and a fuel in a combustor thereby producing a combustion gas; work expanding the combustion gas in the gas turbine; and using at least a portion of the work generated to drive the compressor mechanically linked to the gas turbine.

16. The process of claim 15 wherein at least a portion of the compressed feed air is derived from the air stream which has been compressed in the compressor which is mechanically linked to the gas turbine.

17. The process of claim 1 which further comprised work expanding the vaporized oxygen of step (c).

18. The process of claim 1 which further comprises work expanding a portion of the higher pressure nitrogen overhead; condensing the expanded nitrogen by heat exchange against liquid descending the second column in a third reboiler/condenser located in the second distillation column between the feed point of the reduced pressure, crude liquid oxygen bottoms and the second reboiler/condenser; and using the condensed nitrogen as reflux for the second distillation column.

19. The process of claim 18 which further comprises condensing the expanded portion (of air) in the third reboiler/condenser prior to introduction into the second distillation column.

20. The process of claim 1 wherein at least a portion of the compressed feed air is derived from an air stream which has been compressed in a compressor which is mechanically linked to a gas turbine.

21. The process of claim 1 wherein in the operation of step (a) the liquid oxygen bottoms portion is reduced in pressure prior to the heat exchange.

22. The process of claim 1 wherein in the operation of step (a) the nitrogen vapor stream is increased in pressure prior to the heat exchange.

23. The process of claim 1 wherein in the operation of step (a) the nitrogen vapor stream is increased in pressure and the liquid oxygen bottoms portion is increased in pressure prior to the heat exchange.

24. The process of claim 1 wherein the cooled, compressed, essentially impurities-free feed air portion fed to the first of two distillation columns and the fraction of the cooled, compressed, essentially impurities-free feed air portion is at least partially condensed by heat exchange against the liquid oxygen bottoms in a first reboiler/condenser located in the bottom of the second distillation column are the same stream.

25. The process of claim 1 wherein the first reboiler/condenser is located in the bottom of the second distillation column.

26. The process of claim 1 wherein the first reboiler/condenser is located external to the second distillation column.

* * * * *